United States Patent [19]

Bloom, Jr.

[11] 4,398,843

[45] Aug. 16, 1983

[54] SELF-ALIGNING ARRANGEMENT FOR THE ECCENTRIC MOUNTING SHAFT OF A VIBRATORY COMPACTOR

[75] Inventor: John J. Bloom, Jr., Aurora, Ill.

[73] Assignee: Caterpillar Tractor Co., Peoria, Ill.

[21] Appl. No.: 308,748

[22] PCT Filed: Dec. 5, 1980

[86] PCT No.: PCT/US 80/1632

§ 371 Date: Dec. 5, 1980

§ 102(e) Date: Dec. 5, 1980

[87] PCT Pub. No. WO 82/O 1904

PCT Pub. Date: Jun. 10, 1982

[51] Int. Cl.[3] ..... E01C 19/38

[52] U.S. Cl. ..... 404/117; 308/173

[58] Field of Search ..... 404/117, 122, 132; 308/72; 301/109, 110, 131

[56] References Cited

U.S. PATENT DOCUMENTS

| | | | |
|---|---|---|---|
| 1,671,701 | 5/1928 | Coats | 308/72 |
| 1,942,194 | 1/1934 | Wallgren | 308/72 |
| 2,083,688 | 6/1937 | Clements | 308/72 X |
| 2,286,770 | 6/1942 | Symons | 209/367 |
| 3,161,250 | 12/1964 | Gardner | 404/132 X |
| 3,290,897 | 12/1966 | Kuehn | 308/72 |
| 3,439,594 | 4/1969 | Cowley | 404/117 |
| 3,610,118 | 10/1971 | Engelhard | 404/117 |
| 3,670,631 | 6/1972 | Gaylord | 404/117 |
| 3,722,381 | 3/1973 | Tuneblom | 404/117 |
| 3,814,531 | 6/1974 | Carnahan | 404/117 |
| 3,814,532 | 6/1974 | Barrett | 404/117 |
| 3,909,147 | 9/1975 | Takata | 404/117 |
| 3,957,319 | 5/1976 | Gorski | 308/72 X |

OTHER PUBLICATIONS

Tampo Manufacturing Co., Inc., (Undated).

*Primary Examiner*—Nile C. Byers, Jr.

*Attorney, Agent, or Firm*—Phillips, Moore, Lempio & Finley

[57] ABSTRACT

The drum of a vibratory compactor is normally resiliently rotatably mounted on a frame and has an eccentric shaft mounted therein by a pair of longitudinally bearing assemblies. The outer races of the bearing assemblies must be precisely mounted in bores defined in carriers secured on the drum and the bores must be precisely aligned to insure the co-incident relationship of the rotational axes of the drum and the shaft. In addition to the potential misalignment problem and manufacturing costs, the bearing assemblies must be preloaded towards each other and the load-carrying to size ratio of the bearing assemblies is normally relatively low. The above prior art problems are avoided by a self-aligning arrangement (28) of this invention which functions to mount a pair of longitudinally spaced bearing assemblies (23) on an eccentric mounting shaft (20) for permitting limited relative movement between the shaft (20) and a drum (11) to place the longitudinal axes (A,A') of the drum (11) and the shaft (20) in co-incident relationship relative to each other.

9 Claims, 4 Drawing Figures

FIGURE 3
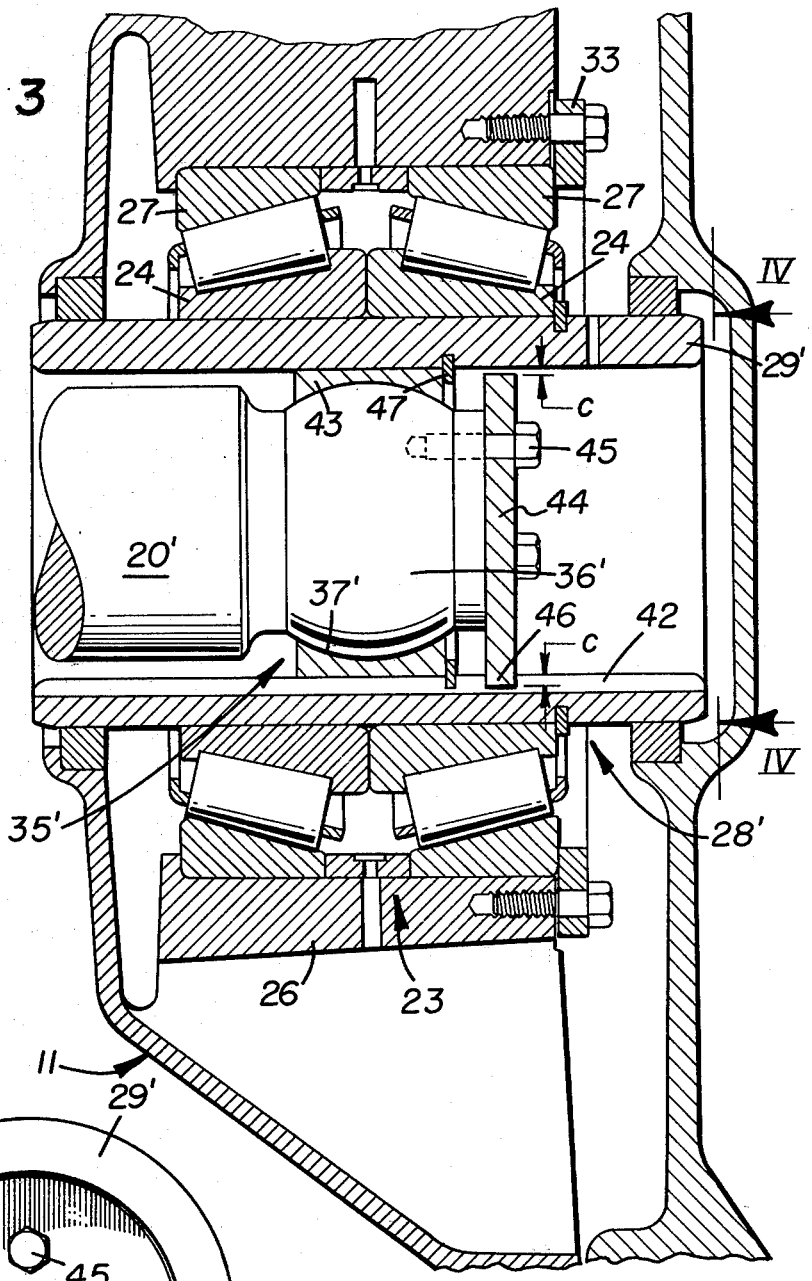
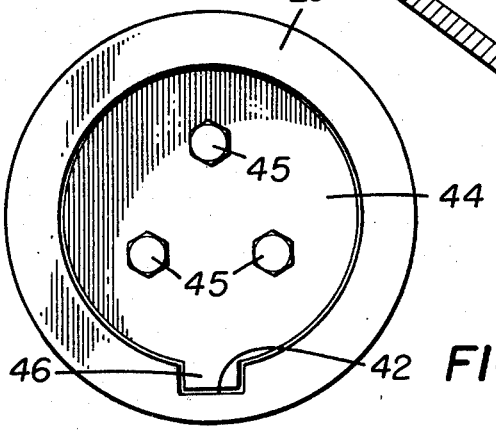
FIGURE 4

SELF-ALIGNING ARRANGEMENT FOR THE ECCENTRIC MOUNTING SHAFT OF A VIBRATORY COMPACTOR

TECHNICAL FIELD

This invention relates generally to an arrangement for supporting an eccentric mounting shaft within a capacitor drum by a pair of axially spaced bearing assemblies and more particularly to means for locating the bearing assemblies on the shaft to place the rotational axes of the drum and shaft in co-incident relationship relative to each other.

BACKGROUND ART

Vibratory compactors are commonly employed for compacting freshly laid asphalt paving, soils, and similar materials. The compactor comprises a drum resiliently and rotatably mounted in a frame assembly wherein an eccentric mounting shaft is located and rotates relative to the drum and which vibrates the drum to provide the desired compaction of the material being worked. The shaft is rotatably mounted in the drum by a pair of longitudinally spaced bearing assemblies which must exhibit high load-carrying capacities during operation of the compactor.

The bearing assemblies normally comprise spherical or tapered roller bearings which require precise preloading to insure maximum system rigidity. Continued use of the compactor oftentimes requires readjustment of the preloading to continuously insure such system rigidity. In addition, the outer races or rings of the bearing assemblies must be precisely aligned longitudinally by a line-boring operation to insure that the rotational axes of the shaft and drum are co-incident to avoid the imposition of adverse loads on the bearing assemblies. Such line-boring is expensive and does not always insure such precise alignment.

The present invention is directed to overcoming one or more of the problems as set forth above.

DISCLOSURE OF INVENTION

In one aspect of the present invention, a vibratory compactor comprises a drum rotatable about its longitudinal axis, an eccentric mounting shaft rotatable about its longitudinal axis, and a pair of bearing assemblies mounting the shaft for rotation in the drum. The improvement in the compactor comprises self-aligning means for mounting each of the bearing assemblies on the shaft for permitting limited relative movement between the shaft and the bearing assemblies to place the longitudinal axes of the drum and the shaft in co-incident relationship relative to each other. The self-aligning means includes a sleeve mounted in each bearing assembly and a ball and socket connection mounting the mounting shaft.

The above improvement insures precise alignment of the shaft and drum without resorting to expensive and time-consuming processes, such as the need for line-boring the mountings in the drum for the outer races of the bearing assemblies. In addition, this invention provides that the bearing assemblies may exhibit a high load-carrying to size ratio in contrast to conventional bearing assemblies of this type. The self-aligning feature of this invention also eliminates the need for periodic readjustment of the preloading of the bearing assemblies and maintains them in a stress-relieved condition of operation.

BRIEF DESCRIPTION OF THE DRAWINGS

Other objects and advantages of this invention will become apparent from the following description and accompanying drawings wherein:

FIG. 3 is a sectional view illustrating a modified self-aligning mounting arrangement; and FIG. 4 is a view taken in the direction of arrows IV—IV in FIG. 3.

BEST MODE OF CARRYING OUT THE INVENTION

Figure 1:
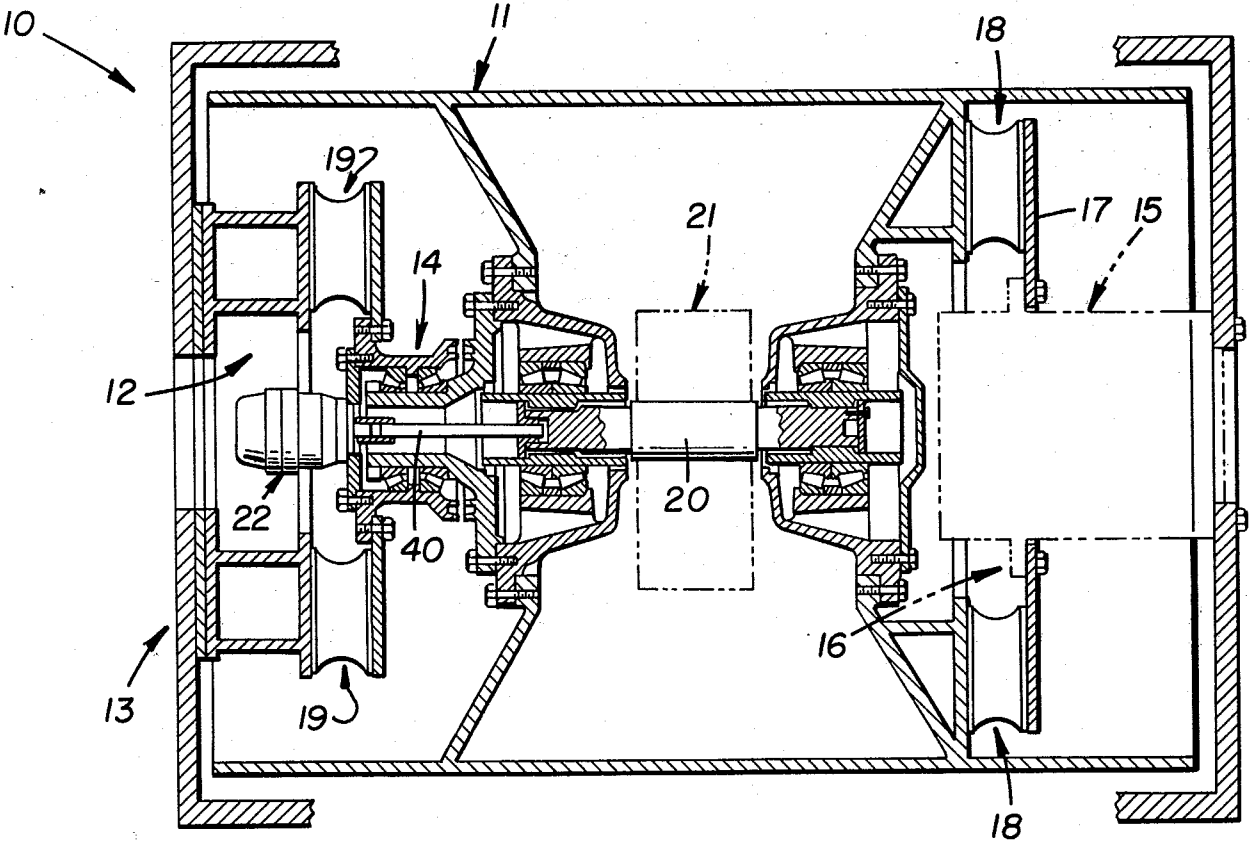
FIG. 1 is a longitudinal and partially sectioned view through a vibratory compactor employing a self-aligning mounting arrangement embodying the present invention.
Figure 2:
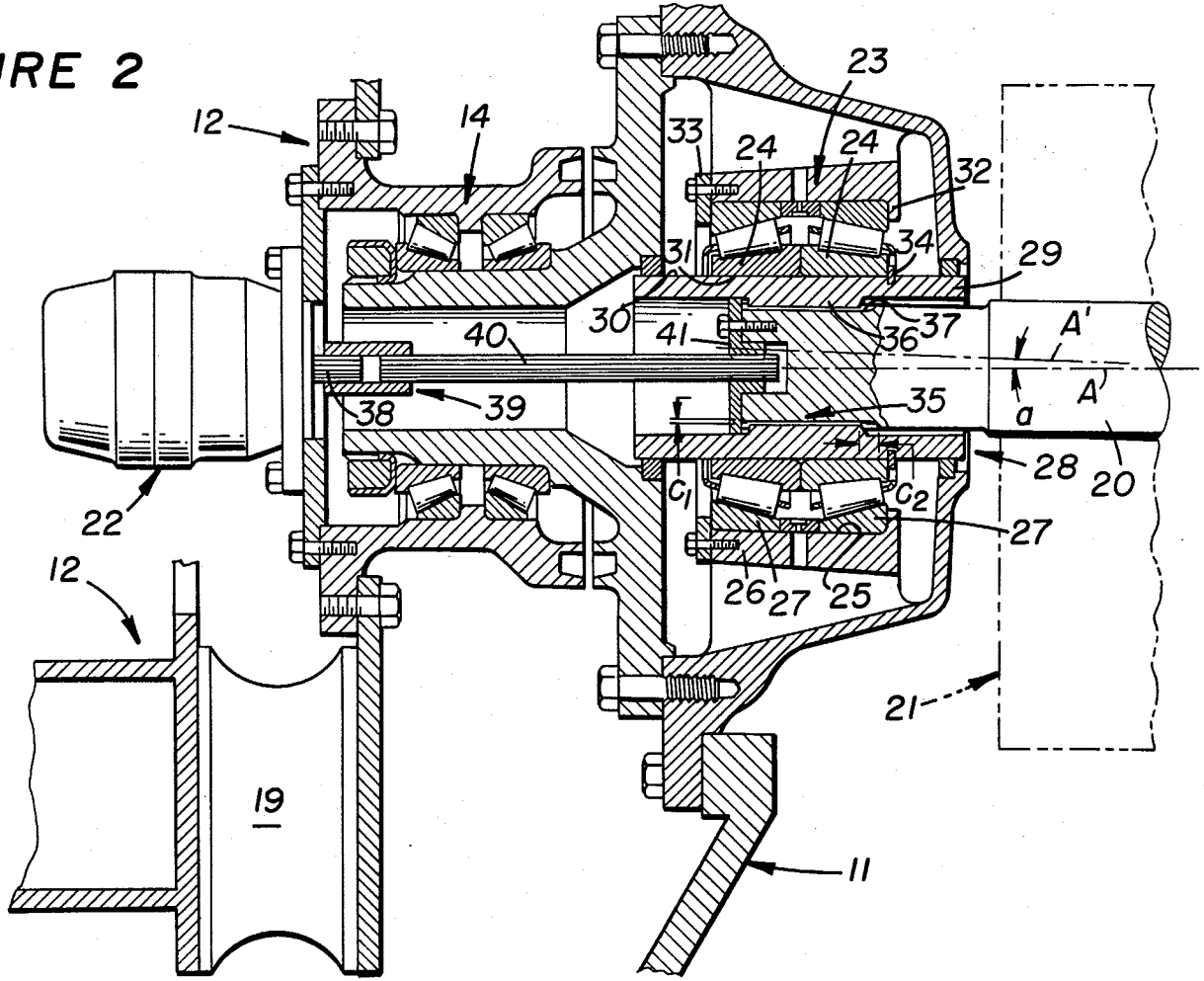
FIG. 2 is an enlarged sectional view more clearly illustrating the mounting arrangement for mounting an eccentric shaft in a drum of the vibratory compactor.

FIGS. 1 and 2 illustrate a portion of a vibratory compactor 10 comprising a drum 11 rotatable about a longitudinal axis A thereof. One end of the drum is rotatably mounted on a mounting bracket assembly 12, secured to a frame structure 13 of a vehicle, by a pair of tapered roller bearing assemblies 14. The opposite end of the drum is connected to an electric or hydraulic drive motor 15 having a drive flange 16 suitably secured to the drum through an annular plate 17 and a plurality of circumferentially spaced elastomeric cushioning pads 18. Similar pads 19 may also connect bracket assembly 12 to frame structure 13 to substantially isolate the vibratory motion of the drum from motor 15 and frame structure 13.

Although FIG. 1 illustrates the selective driving of drum 11 by motor 15, it should be understood that the drum could be non-driven. In the latter construction, the motor and attendant structures would be eliminated and replaced by supporting structures similar to mounting bracket assembly 12 and bearing assemblies 14 for rotational support of the drum on the frame structure of the vehicle. In either case, an eccentric mounting shaft 20 is rotatably mounted in drum 11 and has an eccentric weight 21 secured thereon to operate in a conventional manner. In particular, as shown in FIG. 2, shaft 20 is selectively driven by an electric or hydraulic motor 22 to generate vibrations which are transmitted to the outer surfaces of the drum for compaction purposes.

A pair of longitudinally spaced bearing assemblies 23, disposed on either side of eccentric weight 21, mount shaft 20 in drum 11 for rotation about its longitudinal or rotational axis A. In conventional practice, inner races 24 of bearing assemblies 23 would be press-fitted or otherwise suitably secured directly onto shaft 20 whereby the bearing assemblies would be directly subjected to loading in response to the vibratory motion of shaft 20. In addition to the need to continuously adjust the preload on such bearings towards each other, bores 25, defined in carriers 26 for outer races 27 of the bearing assemblies, would require precise machining to make them concentric in respect to the rotational axes of drum 11 and shaft 20.

Referring to FIG. 2, this invention provides a self-aligning means 28 for each bearing assembly 23 for permitting limited relative movement between shaft 20 and the bearing assemblies to place longitudinal axis A of drum 11 and the longitudinal or rotational axis A′ of shaft 20 in co-incident relationship relative to each other. In addition to avoiding the need for the above-described line-boring of the carriers for outer races 27 of bearing assemblies 23, the bearing assemblies will not require preloading. It will be further appreciated that self-aligning means 28 will aid in preventing bearing assemblies 23 from being subjected to undue loading which could adversely affect the service lives thereof.

Still referring to FIG. 2, self-aligning means 28 comprises a tubular sleeve 29 having an outer cylindrical surface 30 press-fitted or otherwise suitably inserted within internal bores 31 defined in inner races 24 of bearing assembly 23. An annular flange 32, integrally formed on carrier 26, a ring 33 attached to the opposite side of the carrier, and a snap ring 34 attached on the periphery of sleeve 29 may be utilized to retain bearing assembly 23 in its pre-set axial position. The desired pre-load is "built-into" bearing assembly 23 prior to its installation in compactor 10.

Self-aligning means 28 further includes a spline connection 35 for connecting shaft 20 in sleeve 29. As shown in FIG. 2, spline connection 35 comprises a plurality of radially disposed and longitudinally extending teeth 36 formed internally of sleeve 29 and a plurality of accommodating slots 37 formed on the periphery of shaft 20. Radial clearances $C_1$ may be defined between the ends of teeth 36 and the bottoms of slots 37 to provide the desired limited relative movement between shaft 20 and sleeve 29. Likewise, a clearance $C_2$ may be defined axially between adjacent ends of teeth 36 and grooves 37 to permit limited longitudinal movement therebetween. The size of such clearances will, of course, depend on the particular design under consideration and should be sufficient to permit a longitudinal axis A′ of shaft 20 to be placed in co-incident relationship relative to longitudinal axis A of drum 11.

As further shown in FIG. 2, an output shaft 38 of motor 22 may be connected to shaft 20 by a flexible coupling 39, an intermediate splined shaft 40, and a connecting plate 41 secured between shafts 20 and 40. Although bearing assembly 23 may be of the ball bearing or cylindrical roller-type, the bearing assembly preferably comprises a set of the illustrated tapered-roller bearings. Bearings of this type are particularly useful to counteract the heavy radial and thrust loads imposed thereon during operation of vibratory compactory 10. As is well-known to those skilled in the art, a bearing of this type is designed so that all elements on the rolling surface and the raceways intersect at a common point on its axis to thus provide true rolling. As mentioned above, maximum system rigidity can be insured by pre-adjusting the bearings assemblies under predetermined preloads.

FIG. 3 illustrates a modified self-aligning means 28′ and attendant structures wherein identical numerals depict corresponding constructions, but wherein numerals depiciting modified constructions are accompanied by a prime symbol (′). It should be noted that illustrated self-aligning means 28′ would be substituted in lieu of the self-aligning means 28 in FIG. 1, on both ends of shaft 20.

Self-aligning means 28′ comprises a sleeve 29′ press-fitted or otherwise suitably mounted within inner races 24 of bearing assembly 23 and a longitudinally extending groove 42 formed internally on the sleeve. An eccentric mounting shaft 20′ is mounted in sleeve 29′ by a ball and socket connection 35′. The connection includes a semi-spherical shaft portion 36′ mounted in a semi-spherical seat 37′, formed in an annular member 43 disposed in the sleeve.

Shaft 20′ is keyed to sleeve 29′ by a plate 44 attached to the end of the shaft by a plurality of cap screws 45. A tongue 46 is formed on plate 44 to engage groove 42 whereby shaft 20′, sleeve 29′, and bearing races 24 will rotate together. A snap ring 47 is attached in sleeve 29′ and is disposed longitudinally between member 43 and plate 44 to limit relative axial movements between the sleeve and shaft. A slight radical clearance C is defined radially between tongue 46 and surface portions defining groove 42, as well as between plate 44 and sleeve 29′ proper, to cooperate with ball and socket connection 35′ for permitting limited relative movement between shaft 20′ and outer races 27 of bearing assembly 23 to place the longitudinal axes of drum 11 and the shaft in co-incident relationship relative to each other for purposes explained above.

As stated above, the leftward end of shaft 20′ may be attached to drive motor 22 in substantially the same manner as described above. In particular, a similar ball and socket connection 35′ would be employed to attach the shaft to the other bearing assembly. Motor drive shaft 40 could be attached to the opposite end of the shaft 20′ by a similar plate 41.

it should be noted in FIG. 3 that self-aligning means 28′ is surrounded by bearing assembly 23.

INDUSTRIAL APPLICABILITY

Compactor 10 of FIG. 1 is particularly useful for the compaction of freshly laid asphalt paving, soil, and similar materials. Although drum 11 is shown to be selectively driven by a motor 15, it should be understood that the drum could be non-driven in the manner described above.

During operation of compactor 10, motor 22 will be selectively driven to rotate eccentric mounting shaft 20 to impart vibratory energy to drum 11. The compaction of the worked material will impose loads on bearing assemblies 23 with self-aligning means 28 functioning to maintain the bearing assemblies substantially stress-free to insure protracted service lives thereof. In particular and referring to FIG. 2, upon assembly of compactor 10, spline connection 35 will insure that longitudinal axes A and A′ of drum 11 and shaft 20, respectively, will be placed in co-incident relationship relative to each other to prevent the imposition of any extraneous loads on each bearing assembly 23. As described above, self-aligning means 28 further provides that bearing assemblies 23 will not require preloading to thus insure structural integrity of the system.

Modified self-aligning means 28′ of FIGS. 3 and 4 will function substantially the same as self-aligning means 28 to place the longitudinal axes of drum 11 and eccentric mounting shaft 20′ in co-incident relationship relative to each other.

Other aspects, objects, and advantages of this invention can be obtained from a study of the drawings, the disclosure, and the appended claims.

I claim:

1. In a vibratory compactor (10) having a drum (11) rotatable about a longitudinal axis (A) thereof, an eccentric mounting shaft (20′) rotatable about a longitudinal axis (A′) thereof, and a pair of longitudinally spaced bearing assemblies (23) rotatably mounting said drum (11) on said shaft (20′) and mounting said shaft (20′) for rotation about the longitudinal axis (A′) thereof, the improvement comprising:

self-aligning means (28′) for mounting each of said bearing assemblies (23) on said shaft (20′) for permitting limited relative movement transversely of said axes (A,A′) between said shaft (20′) and said bearing assemblies (23) to place the longitudinal axes (A,A′) of said drum (11) and said shaft (20′) in co-incident relationship relative to each other, said self-aligning means (28′) including a sleeve (29′) mounted in each of said bearing assemblies (23) and a ball and socket connection (35′) mounting said shaft (20′) in said sleeve (29′).

2. The vibratory compactor (10) of claim 1 wherein each of said bearing assemblies (23) includes a pair of tapered roller bearing assemblies.

3. The vibratory compactor (10) of claim 1 wherein each of said bearing assemblies (23) includes an inner race (24) defining a cylindrical internal bore (31) therethrough and wherein said sleeve (29′) has a cylindrical outer surface fitted within said bore (31).

4. The vibratory compactor (10) of claim 3 wherein each of said bearing assemblies (23) further includes a pair of tapered roller bearings each having an outer race (27) mounted in said drum (11) and wherein said inner race (24) is mounted directly on the outer surface of said sleeve (29′).

5. The vibratory compactor (10) of claim 1 wherein said eccentric mounting shaft (20) includes an eccentric weight (21) secured thereon and disposed longitudinally between said bearing assemblies (23), said bearing assemblies (23) solely rotatably mounting said shaft (20) in said compactor (10).

6. The vibratory compactor (10) of claim 1 wherein said self-aligning means (28′) further includes a longitudinally extending groove (42) defined internally on said sleeve (29′) and a plate (44) attached to said shaft (20′) and having a tongue (46) engaged within said groove (42).

7. The vibratory compactor (10) of claim 1 wherein said self-aligning means (28′) is surrounded by a respective one of said bearing assemblies (23).

8. A vibratory compactor (10) comprising a drum (11) rotatable about a longitudinal axis (A) thereof, a shaft (20′) having an eccentric weight (21) secured thereon and rotatable about a longitudinal axis (A′) thereof, a pair of longitudinally spaced bearing assemblies (23) each having at least one outer race (27) mounted in said drum (11) and an inner race (24), a tubular sleeve (29′), said inner race (24) mounted on said sleeve (29′) and a ball and socket connection (35′) mounting said shaft (20′) in said sleeve (290′) and surrounded by a respective one of said bearing assemblies (23).

9. The vibratory compactor (10) of claim 8 further including a longitudinally extending groove (42) defined internally on said sleeve (29′) and a plate (44) attached to said shaft (20′) and having a tongue (46) engaged within said groove (42).

* * * * *